United States Patent [19]

Yoshida et al.

[11] Patent Number: 4,801,090

[45] Date of Patent: Jan. 31, 1989

[54] DISCHARGE PIPE AND DISCHARGE APPARATUS USING THE SAME

[75] Inventors: Yoshiyuki Yoshida; Kazutaka Onozuka, both of Tokyo; Yoshihiko Ohashi, Fujisawa; Toshihide Tsuji; Kensuke Miyazaki, both of Sagamihara; Yoshio Koyama, Toyonaka, all of Japan

[73] Assignees: Hochiki Corp., Tokyo; Kabushiki Kaisha Takenata Komuten, Osaka, both of Japan

[21] Appl. No.: 916,234

[22] Filed: Oct. 7, 1986

[30] Foreign Application Priority Data

Oct. 9, 1985 [JP] Japan ..... 60-154761

[51] Int. Cl.[4] ..... A62C 35/00

[52] U.S. Cl. ..... 239/290; 239/424; 239/428.5; 239/443; 169/16

[58] Field of Search ..... 239/443–445, 239/416.4, 416.5, 419.5, 423, 424, 428, 428.5, 429, 290, 296, 8, 436, 447, 371, 434.5; 169/25, 16; 137/13, 888

[56] References Cited

U.S. PATENT DOCUMENTS

| | | | |
|---|---|---|---|
| 372,299 | 11/1887 | Chamberlin | 137/13 |
| 1,268,359 | 6/1918 | Beal | 239/428 |
| 2,681,830 | 6/1954 | Peterman | 239/240 |
| 2,695,813 | 11/1952 | Rosanowski | 239/428 |
| 2,841,229 | 7/1958 | Guise | 169/25 |
| 2,985,384 | 5/1961 | Martin | 239/428 |
| 3,053,271 | 12/1972 | Freshair et al. | 239/8 |
| 3,073,534 | 1/1963 | Hampshire | 239/424 |
| 3,266,737 | 8/1966 | Nees | 239/548 |
| 3,820,714 | 6/1974 | Erickson et al. | 137/13 |
| 3,993,097 | 11/1976 | Verschuur | 137/13 |
| 4,134,547 | 1/1979 | Gamst | 239/434.5 |
| 4,510,958 | 4/1985 | Coursen | 137/13 |

FOREIGN PATENT DOCUMENTS

| | | | |
|---|---|---|---|
| 1944309 | 3/1971 | Fed. Rep. of Germany | 239/290 |
| 608902 | 5/1978 | U.S.S.R. | 239/428.5 |

*Primary Examiner*—Andres Kashnikow
*Assistant Examiner*—Kevin P. Weldon
*Attorney, Agent, or Firm*—Lackenbach Siegel Marzullo & Aronson

[57] ABSTRACT

A water jet discharge pipe which produces a wide effective spray area and long water reach at low pressure and water volume. Compressed air is injected around the periphery of the pressurized water stream produced through an inner cylindrical member and which is throttled by a nozzle extending into such inner cylindrical member. The injected air prevents reduction of the flow velocity of the water by contact with the inner wall of the cylindrical member. In addition, external air is introduced through air inlets in an outer cylindrical member extending from the inner cylindrical member so as to straighten the air layer accompanying the water jet exiting from the inner cylindrical member and suppress premature dispersal of the water stream prior to ejection from the outer cylindrical member. After such ejection, expansion of the injected air atomizes the water stream to provide large area coverage thereof.

14 Claims, 5 Drawing Sheets

DISCHARGE PIPE AND DISCHARGE APPARATUS USING THE SAME

FIELD OF THE INVENTION AND RELATED ARTS

This invention relates to a discharge pipe and discharge apparatus employing the same usable for extinguishing a large-scale fire or a fire which will otherwise become a large fire. This invention relates more and discharge apparatus employing the same which are suited especially for fire fighting in a large-space structure such as a stadium or a pavilion.

In the case of a large-scale fire, it is general to use water jet from a nozzle to extinguish the fire. However, nozzles widely employed heretofore have such a disadvantage that a great deal of water is lost, in the form of spray, from the jet stream. As the range of the jet stream increases, the loss of water is increased. Many attempts have been made to obviate the disadvantage. One of them has been reported in "An Improved General Purpose Jet-spray Branch," *Fire Prevention,* June/July 1984 published by Fire Protection Association, Aldermary House, Queen Street, London EC4N 1T. The behavior of water jet is analyzed in "The Trajectories of Large Fire Fighting Jets," *The International Journal of Heat and Fluid Flow,* vol. 1, no. 1 published by MEP Ltd., Bury St. Edmunds, Suffork.

These improved nozzles are adapted to apply a large amount of extinguishing water to a distant object in the form of water jet. According to the first literature cited above, a special device has been provided in an inner face configuration of a nozzle. This nozzle is expected to effectively send a large quantity of water together to a remote object. This effect is considered to be due to the device provided in the inner surface configuration of the nozzle which allows the flow rate distribution of the water jet caused to be equalized all over the nozzle diameter.

This improved nozzle, however, has the shortcoming that it can effectively supply water only within a limited small area since the spraying and scattering is minimized. In addition, it is inferred from the literature as cited above that a considerably high-pressure and large quantity water such as 10 $Kgf/cm^2$ and about 6,000 1/min. is required for the improved nozzle to ensure a water reach as long as 100 m. As a large amount of such high-pressure water hits a relatively small area at an acute angle slightly downward, it causes considerable damages. Furthermore, when water is required to be sprayed to a remote place, a high-performance pump is needed to raise the pressure of the fire extinguishing water and use of high-pressurized fire extinghuisihing water requires piping equipments which are suited to the high-pressure required. In case this improved nozzle is applied to a large structure such as a stadium or pavilion, a considerable number of nozzles are necessitated due to their narrow spray area, which will give an undesirable effect for the arrangements of the facilities in the structure. On the other hand, if the range to be covered by one nozzle is extended, it will be difficult to sight accurately the nozzle to the spreading area of fire and high-performance sighting of the nozzle is required. Further, there is a fear that serious damages are caused on the inside facilities or persons due to the large breaking energy of the water. The increase of the pressure of the fire extinguishing water will require that the piping etc. be durable against the high pressure, which will increase an installation cost.

Sprinklers have also been known as fire equipments which are effective for spraying water in a relatively wide area. However, in the case of a large structure such as have recently become popular, the water sprayed from the sprinkler falls for a long time because of the high cewiling, such as a height over 20 m, so that the sprayed water may be blown by heated air current in the course of falling. In such a case, effective fire extinguishing can not be expected. In the case of a large space structure known as an air dome which has a flexible, light membrane ceiling structure, it is quite difficult to mount sprinklers on the membrane. Thus, there has been demanded fire extinguishing equipments having a nozzle which can obviate the problems involved in the prior arts.

OBJECTS AND SUMMARY OF THE INVENTION

The present invention has been achieved to solve the problems as described above, and it is an object of the present invention to provide a discharge pipe and discharge apparatus using the same which is capable of getting a long water reach under a relatively low pressure while attaining a wide spray area and a discharge apparatus employing the same.

The present invention features a discharge pipe comprising: a nozzle for throttling fire-extinguishing water supplied under pressure to jet therethrough; an inner cylindrical member provided adjacent to an exit of said nozzle; an air injecting means for blowing compressed air into said fire extinguishing water jetted through said nozzle into said inner cylindrical member along an inner face thereof; an outer cylindrical member provided around said inner cylindrical member, having an extension extended from an exit of said inner cylindrical member in a direction of the jetting of said fire extinguishing water; and one or more air inlets on the outside of the outer periphery of said inner cylindrical member.

The present invention further features a discharge apparatus comprising the above-specified nozzle usable for fire extinguishing of a remote place and a short reach nozzle adapted to atomize and spray fire extinguishing water which is usable for fire extinguishing in the vicinity of the discharge apparatus.

With the arrangement of the discharge pipe according to the present invention, air is injected around the periphery of the water stream when pressurized fire extinguishing water is throttled by the nozzle member to be jetted into the inner cylindrical member, so that the air injected may prevent lowering of the flow velocity of the water stream in contact with the inner walls of the nozzle and the cylindrical member and may atomize the water stream due to the expansion of the air injected. In addition, external air is introduced through the air inlets on the outer cylindrical member to straighten an air layer accompanying the water stream jetted from the inner cylindrical member and suppress early branching of the water stream. As results of these features, a wide effective spray area and a long water reach can be obtained at low pressure and with a small quantity of extinguishing water.

DESCRIPTION OF PREFERRED EMBODIMENTS

Figure 1:
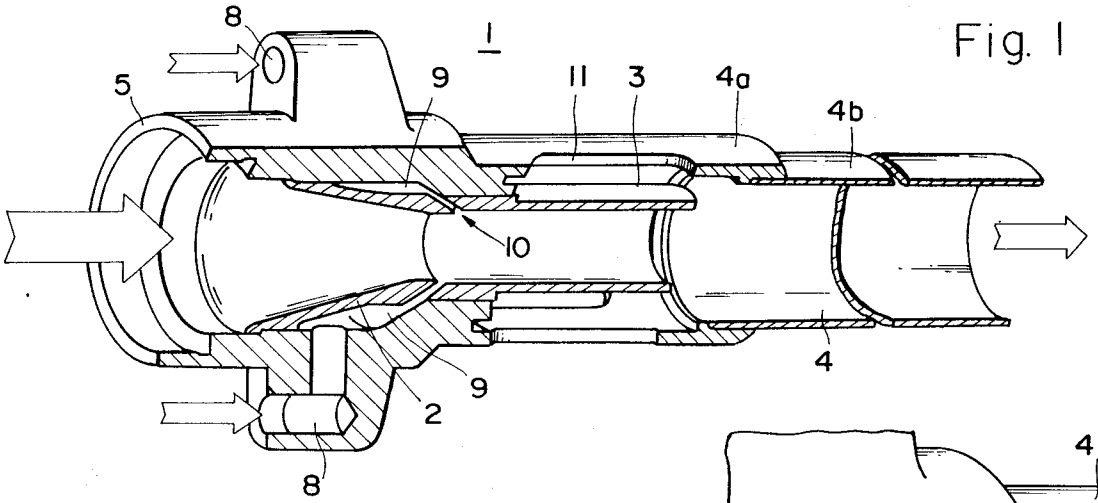
FIG. 1 is a partly cut-away perspective view of one form of a discharge pipe according to the present invention.
Figure 3:
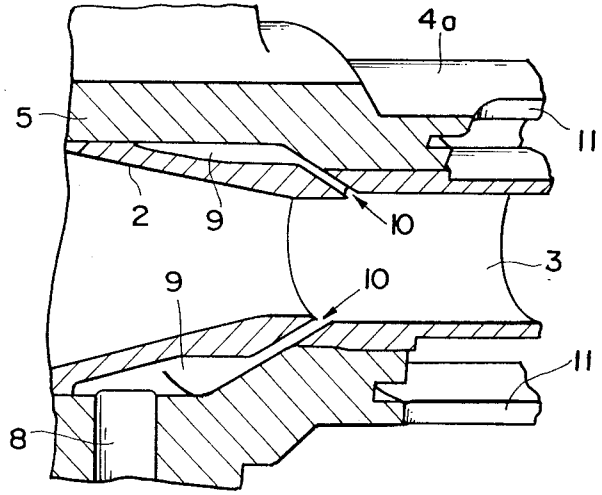
FIG. 3 is an enlarged fragmentary view of slits formed between a nozzle and an inner cylindrical member of the nozzle shown in FIG. 1.
Figure 2:
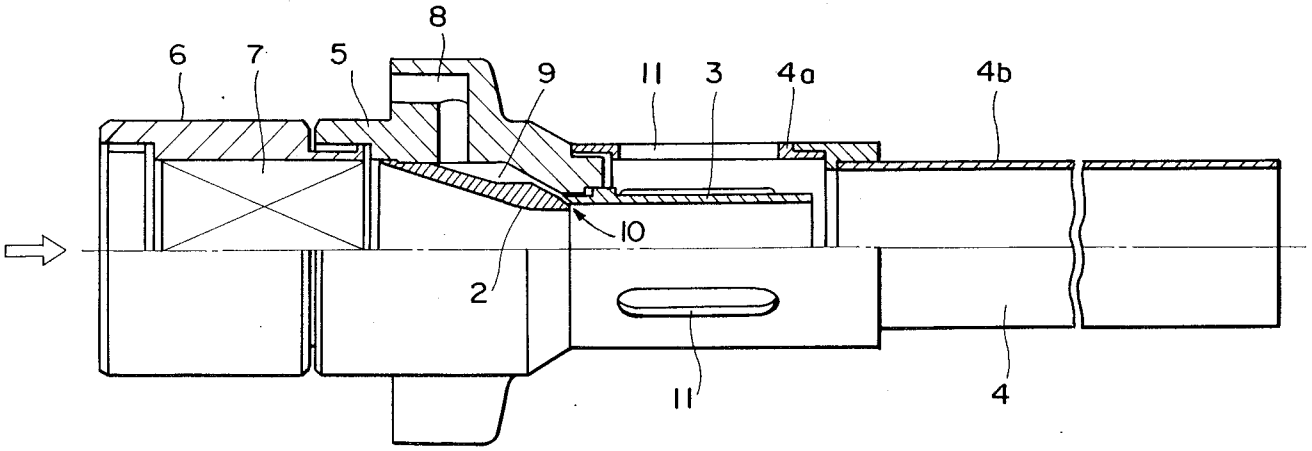
FIG. 2 is a partly cut-away side elevational view of the discharge pipe of FIG. 1.

A discharge pipe 1 according to the present invention comprises, as illustrated in FIG. 1, a nozzle 2, an inner cylindrical member 3, an outer cylindrical member 4 and an air injecting unit 5. The nozzle 2 is fully fitted in the air injecting unit 5. The inner cylindrical member 3 is fitted, at one end thereof, in the air injecting unit 5. The inserted end of the inner cylindrical member 3 is adjacent to an exit of the nozzle member 2. The outer cylindrical member 4 is several times as long as the inner cylindrical member 3 and is fixed to a tip end of the air injecting unit 5 so as to fully envelope the inner cylindrical member 3. On an end of the air injecting unit 5 which is opposite to the inner and outer cylindrical members 3 and 4, a stream straightener 6 is fitted as shown in FIG. 2. The stream straightener 6 comprises a stream straightening member 7 therewithin for straightening the stream of fire extinguishing water supplied under pressure by a fire extinguishing pump (not shown) into an axial direction.

The nozzle 2 is of a conventional type having a conical shaped inner surface. The stream of the fire extinguishing water straightened by the stream straightener 6 is throttled here to be accelerated and ejected from the exit of the nozzle 2 into the inner cylindrical member 3.

The air injecting unit 5 has, on the outer periphery thereof, a pair of compressed air inlets 8. An air injecting chamber 9 having a rhombic shape in section is defined between the air injecting unit 5 and the nozzle 2. Compressed air of a given pressure is fed from the air inlets 8 into the air injecting chamber 9.

The nozzle 2 has a tapered or slanting outer peripheral surface at the tip end thereof and the inner cylindrical member 3 has a complementary tapered or slanting inner peripheral surface at the base end thereof. The nozzle 2 and the inner cylindrical member 3 are spaced slightly so as to form an annular gap 10 therebetween. The compressed air in the air injecting chamber 9 is injected into the inner cylindrical member 3 through the gap 10. The compressed air is injected preferably along the inner surface of the cylindrical member 3. The spacing of the gap 10 is about 0.5 mm in an experiment as will be described in detail later, but the spacing may be suitably selected according to a discharge quantity, a discharge pressure, an internal caliber of the nozzle and so on. The outer cylindrical member 4 comprises a base member **4*a* of a slightly larger diameter and a separate stack member 4*b* of a smaller diameter which are force-fitted to each other. The base portion 4*a* is mounted on the air injecting unit 5 so as to envelope the inner cylindrical member 3. The base portion 4*a* has a plurality of air suction openings 11. The air suction openings 11 are formed so that their ends do not extend beyond the tip end of the inner cylindrical member 3 and is air for forming an accompanying air layer for stream straightening around the jet stream ejected from the inner cylindrical member 3. The stack member 4*b* is far longer than the base portion 4*a* or the inner cylindrical member 3. The optimum length of the stack member 4*b* may be determined in accordance with a condition of discharging. The inner diameter of the stack member 4*b* is about twice as large as that of the inner cylindrical member 3 in the embodiment as illustrated, but the optimal inner diameter of the stackmember 4*b* may be again determined experimentally. The outer cylindrical member 4** may alternatively be formed integral.

Figure 4:
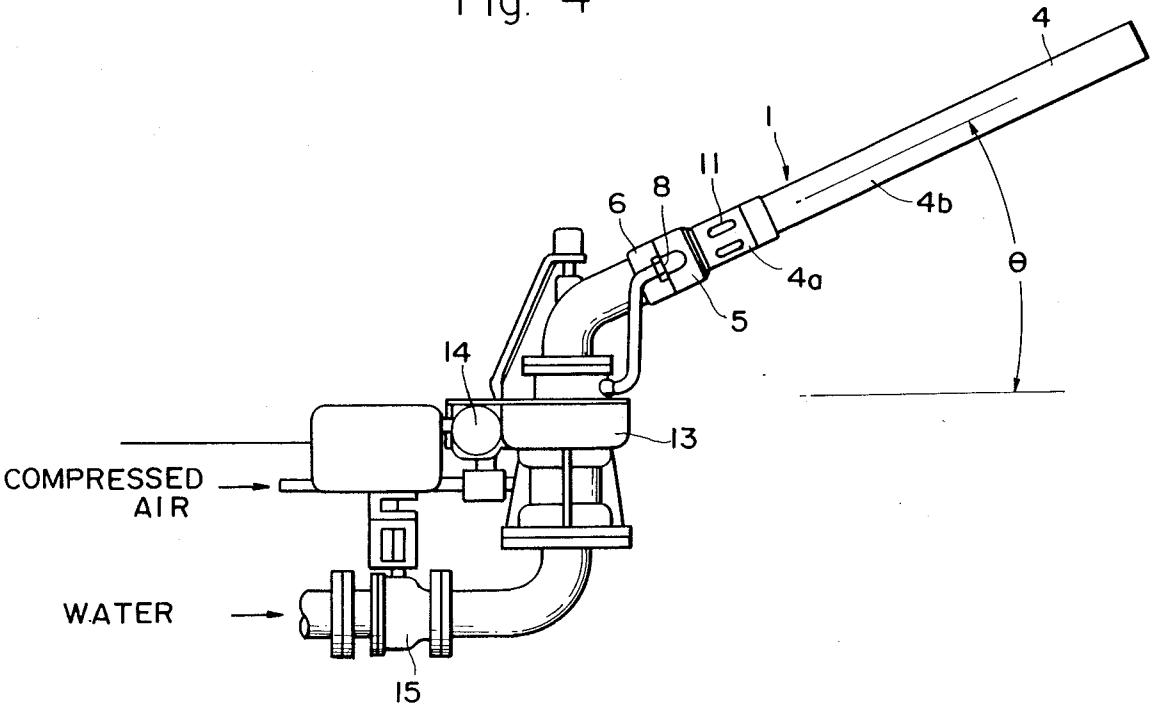
FIG. 4 shows an entire elevational view of the first embodiment of the present invention for which the discharge pipe of FIG. 1 being employed.

FIG. 4 shows an appearance of a discharge apparatus which incorporates therein the discharge pipe 1 as described above. The pipe 1 is mounted on a rotatable base 13 with a given water discharging angle of $\theta$. The nozzle 1 is rotatable in a horizontal direction by a remote control of a motor 14 or a manual operation through a handle (not shown). In FIG. 4, 15 is electric valve which is provided for controlling the discharge.

The operation of the embodiment as described above will now be described.

Fire extinghising water supplied under desirable pressure controlled by the valve 15 is supplied to the nozzle 2 through the stream straightener 6 and throttled by the nozzle 2 to be accelerated and then jetted into the inner cylindrical member 3.

On the other hand, compressed air introduced through the air inlets 8 of the air injecting unit 5 enters the air injecting chamber 9 and is ejected into the inner cylindrical member 3 through the gap 10. This compressed air is injected uniformly into the water stream in the inner cylindrical member 3 from therearound. As a result of this, the water stream passing through the inner cylindrical member 3 gets mingled with the injected air layer in contact with the inner wall of the inner cylindrical member 3. Therefore, the water stream jetted into the inner cylindrical member 3 from the nozzle 2 is discharged from the inner cylindrical member 3 into the outer cylindrical member 4, with a substantially uniform flow rate distribution, without reducing its speed due to a resistance caused by contact with the inner surfaces of the nozzle 2 and the inner cylincrical member 3.

The water stream ejected into the outer cylindrical member 4 flows vigorously within the stack member **4*b* to be discharged outside therefrom. The air in a gap between the base member 4*a* and the inner cylindrical member 3 is drawn into the stack member 4*b* by the water stream within the stack member 4*b*. The air drawn into the stack member 4*b* forms part of an air layer accompanying the water stream when it is discharged outside from the stack member 4*b*, while straightening the accompanying air layer. External air is introduced in a way of natural ventilation into the gap between the base member 4*a* and the inner cylindrical member 3 through air intakes 11 provided in the base member 4*a***.

The water stream discharged from the outer cylindrical member 4 is atomized due to an expansion of the air compressed in the stream. The compressed air becomes part of the accompanying air layer after it has been expanded.

Thus, speed slow-down within the inner cylindrical member 3 is prevented and the accompanying air layer is straightened within the outer cylindrical member 4 to ensure long water reach using low pressure water and part of the water stream is atomized by the compressed air therein to provide a wide water discharge pattern.

The experiments conducted by the present inventors will now be described.

Fire extinguishing water was supplied, after being controlled in pressure by the electric valve, to the discharge pipe at a flow rate of 3300 1/min under a pressure of 8 Kgf/cm$^2$, at a flow rate of 2500 1/min under a pressure of 5 Kgf/cm$^2$ and at a flow rate of 1800 1/min under a pressure of 3 Kgf/cm$^2$. 6.5 Kgf/cm$^2$ compressed air was supplied for the air injection. A water discharge angle $\theta$ of the discharge assembly is set at 25°.

Figure 5:
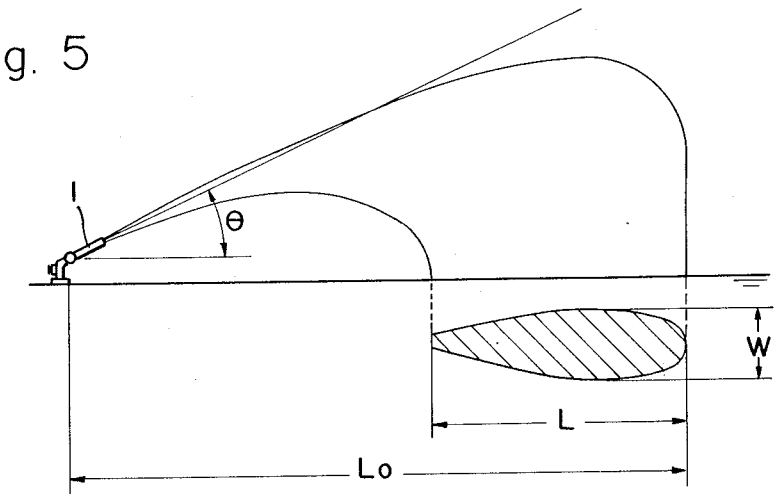
FIG. 5 shows an effective water scattering area of the discharge pipe according to the present invention.
Figure 6:
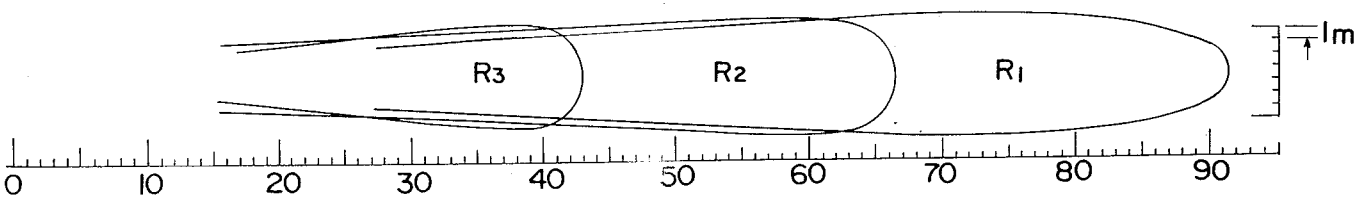
FIG. 6 shows effective water scattering areas for three different water pressures, respectively.

By the water discharge under these three discharge conditions, a discharge area shown in plane as denoted by shadows in FIG. 5 is obtained. The discharge area as denoted by the shadows shows a water scattering area over which there is a water spraying ability of about 6 1/m$^2$ which corresponds to the water spraying ability of a sprinkler. The detailed water spray areas under the respective water spray conditions are as shown in FIG. 6. A area R1 shows a pattern in the case of 8 Kgf/cm$^2$, a area R2 shows a pattern in the case of 5 Kgf/cm$^2$ and a area R3 shows a pattern in the case of 3 Kgf/cm$^2$. Thus, the discharge apparatus according to the present invention can have such water discharge performances as spray width W=7 m, full spray length L=75 m and maximum water reach Lo=90 m.

As a sufficiently long water reach Lo can be obtained together with a widely extending water spray area having a large spray width W and spray length, a fire source remote 90 m or so in a large structure such as a stadium or pavilion can be hit by the fire extinguished water. Besides, the water can be sprayed over a wide range while aquiring a sufficiently long water reach under a low pressure without wasting the fire extinguishing water. In addition, since the water discharged will fall down onto the spray area after it has lost its kinetic energy in a forward direction, a secondary damage such as destruction which may be caused by direct hit of the water stream can be prevented.

Figure 7:
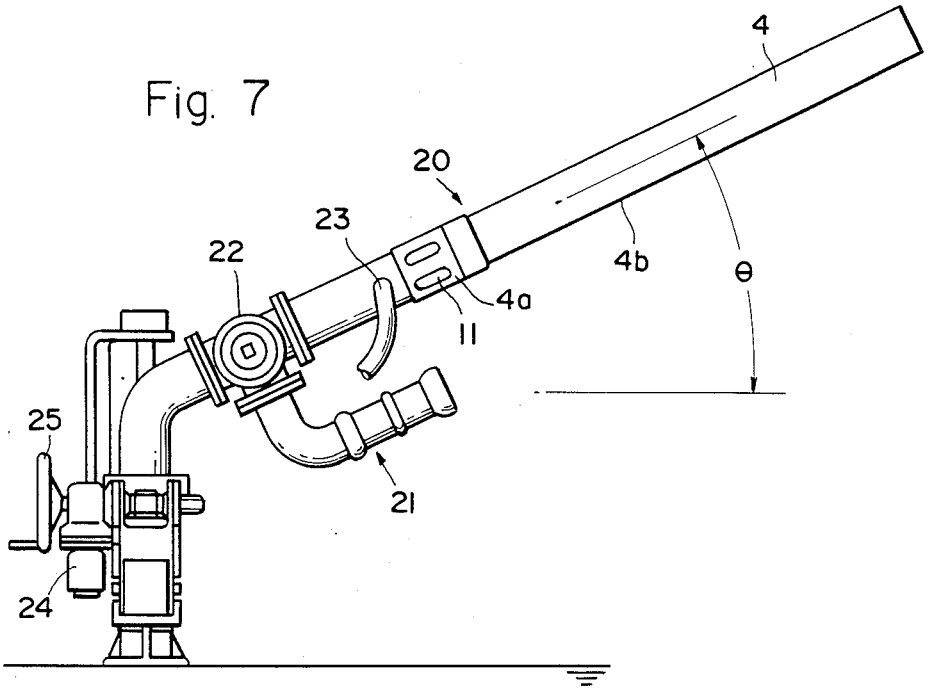
FIG. 7 shows the second embodiment of a discharge apparatus according to the present invention.
Figure 8:
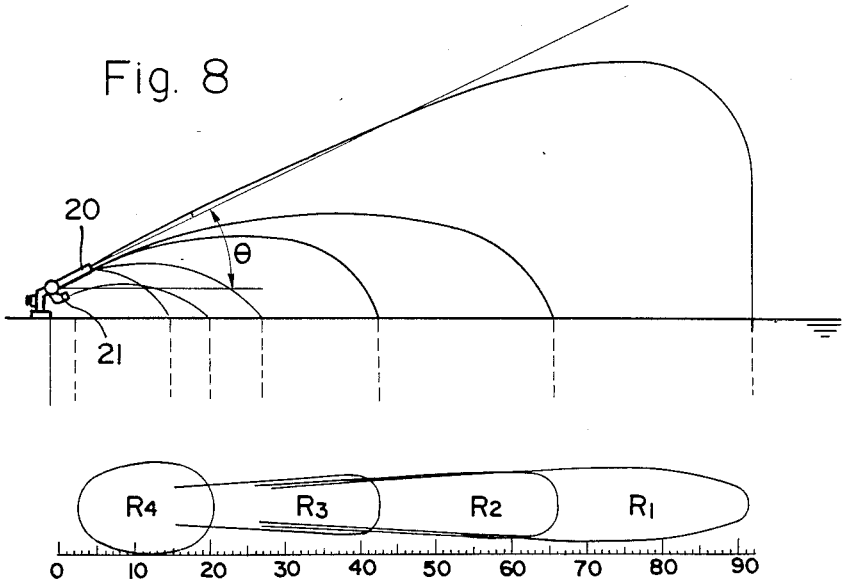
FIG. 8 shows effective water scattering areas of the discharge apparatus of FIG. 7.

FIG. 7 and FIG. 8 illustrate another form of a discharge apparatus to the present invention. This apparatus is adapted to make water spraying not only to a remote place but to a near place, even to a place just beneath the apparatus itself.

More particularly, the discharge apparatus of the foregoing embodiment has a difficulty in spraying to a very near place, especially to a place just beneath itself, although it can cover a relatively wide area from near to remote. To solve this difficulty, the discharge pipe may be rotated in a vertical direction so as to cover the place beneath itself. In this case, however, water directly hits articles or persons before it has lost its kinetic energy, which possibly gives damages thereonto. To obviate this problem requires very complicated structures. Alternatively, water pressure may be adjusted so as to make water spraying to a place nearer than the area as shown in FIG. 6. The appropriate spray condition can not be obtained when the water pressure is extremely lowered. This will raise another problem that the effectiveness of the fire extinguishing ability will be lowered. Or, a plurality of discharge pipes may be installed so that a place just beneath one pipe may be covered by another apparatus. However, this is not always applicable, because this idea may be employable only when the inner arrangement of the structure is suited thereto.

The discharge apparatus of the present embodiment comprises, in combination, a long reach discharge pipe 20 for spraying water to a remote place and a short reach discharge pipe 21 for spraying water to a near place. Pressurized water is supplied to the discharge pipe 20 and 21 through a three-way selector valve 22.

The long reach discharge pipe 20 is substantially the same as the discharge pipe of the foregoing embodiment. Therefore, the spray area is also similar to that of the foregoing embodiment as illustrated in FIG. 8.

The short reach discharge pipe 21 may be a common spray device which may spray water within a area R4 as illustrated in FIG. 8, for example, within a area of 20 m right under the apparatus. With this arrangement, the discharge pipe of the present embodiment can cover a area of from substantially 0 m to 90 m.

In FIG. 7, 23 is a compressed air pipe, 24 is a motor and 25 is a handle. The discharge apparatus of the present embodiment is rotated horizontally by the motor or handle.

Various modifications other than those as described above may be included in the present invention. For example, the air injecting unit 5 may be so formed that it may cover only the gap 10 between the inner cylindrical member 3 and the outer cylindrical member 4. The spacing of the gap 10 may be changeable and the gap 10 may be formed as elongated slots or a slits arranged in a circle. Of course medivcal foaming material and other extinguishing material can be used for the discharge pipe of the present invention. Therefore, all the variations and modifications may be included within the scope of the claim of the present invention so long as they are not out of the spirit of the present invention.

We claim:

1. A discharge pipe comprising: a nozzle for throttling fire-extinguishing water supplied under pressure to jet it therethrough;

an inner cylindrical member, which has a hollow and straight shape, provided adjacent to an exit tip end of said nozzle;

the inner face of said inner cylindrical member is straight in the direction of the jetting of said fire extinguishing water;

an air injecting means of injecting compressed air into said fire extinguishing water jet where it exits from said nozzle and jets into said inner cylindrical member, such air injection being directed so that the compressed air flows along an inner face of said inner cylindrical member; and an outer cylindrical member, which has a hollow and straight shape, provided around said inner cylindrical member;

said outer cylindrical member has an extension portion that extends beyond said exit tip end of said inner cylindrical member in a direction of the jetting of said fire extinguishing water, an inner face which is parallel with said inner face of said inner cylindrical member and is straight in a direction of the jetting of said fire extinguishing water, and provided with one or more air inlets adjacent the outside of the outer periphery of said inner cylindrical member.

2. A discharge pipe as claimed in claim 1 wherein the injected compressed air is directed by a gap between a connecting portion of said cylindrical member and said nozzle at the exit therefrom, such gap guiding air introduced by said air injecting means.

3. A discharge pipe as claimed in claim 2, wherein said gap is shaped in the form of a ring extending around said connecting portion.

4. A discharge pipe as claimed in claim 3, wherein sid air injecting means comprises a cylindrical air injecting unit surrounding the outer periphery of said gap, said air injecting unit having a guide passage for guiding compressed air into said gap.

5. A discharge pipe as claimed in claim 4, wherein said gap is slanted so as to be generally along the jetting direction of sid fire extinguishing water for causing said compressed air to flow along an inner wall of said inner cylindrical member.

6. A discharge pipe as claimed in claim 5, wherein said nozzle has a conical inner shape.

7. A discharge pipe as claimed in claim 4, wherein said one or more air inlets on the outer cylindrical member are shaped in elongated slot form and extend along an axis of the outer cylindrical member.

8. A discharge pipe as claimed in claim 7, wherein sid inner cylindrical member has a tip end which extends towards a tip end of said outer cylindrical member beyond the air inlets of elongated slot form.

9. A discharge pipe as claimed in claim 8, wherein sid nozzle has a conical inner shape.

10. A discharge apparatus comprising a long reach discharge pipe for fire extinguishing a place remote from where said long reach discharge pipe is installed; and a short reach discharge pipe for fire extinguishing a place in the vicinity of said long reach discharge pipe;

said long reach discharge pipe including, a nozzle for throttling fire-extinguishing water supplied under pressure to jet it therethrough;

an inner cylindrical member, which has a hollow and straight shape, provided adjacent to an exit tip end of said nozzle;

the inner face of said inner cylindrical member is straight in the direction of the jetting of said fire extinguishing water;

an air injecting means for injecting compressed air into said fire extinguishing water jet where it exists from said nozzle and jets into said inner cylindrical member, such air injection being directed so that the compressed air flows along an inner face of said inner cylindrical member; and an outer cylindrical member, which has a hollow and straight shape, provided around said inner cylindrical member, said outer cylindrical member has an extension portion that extends beyond said exit tip end of said inner cylindrical member in a direction of the jetting of said fire extinguishing water, an inner face which is parallel with said inner face of said inner cylindrical member and is straight in a direction of the jetting of said fire extinguishing water, and provided with one or more air inlets adjacent the outside of the outer periphery of said inner cylindrical member;

said short reach discharge pipe being adapted to spray the fire extinguishing water;

said long reach discharge pipe and said short rech discharge pipe being connected through a selector valve so as to be switchable.

11. A discharge apparatus as claimed in claim 10, which further comprises a gap at a connecting portion between said nozzle and said inner cylindrical member for guiding air introduced by said air injecting means.

12. A discharge apparatus as claimed in claim 11, wherein said gap is shaped in the form of a ring extending around said connecting portion.

13. A discharge apparatus as claimed in claim 12, wherein said air injecting means comprises a cylindrical air injecting unit surrounding the outer periphery of said gap, said air injecting unit having a guide passage for guiding compressed air into said gap.

14. A discharge apparatus as claimed in claim 13, wherein said gap is slanted so as to be generally along the jetting direction of said fire extinguishing water for causing said compressed air to flow along an inner wall of said inner cylindrical member.

* * * * *